US007434670B2

(12) United States Patent
Good et al.

(10) Patent No.: US 7,434,670 B2
(45) Date of Patent: Oct. 14, 2008

(54) SUPPORT APPARATUS AND METHOD FOR CERAMIC MATRIX COMPOSITE TURBINE BUCKET SHROUD

(75) Inventors: Randall Richard Good, Simpsonville, SC (US); Kevin Leon Bruce, Greer, SC (US); Gregory Scot Corman, Ballston Lake, NY (US); David Joseph Mitchell, Niskayuna, NY (US); Mark Stewart Schroder, Hendersonville, NC (US); Christopher Grace, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 203 days.

(21) Appl. No.: 11/504,673

(22) Filed: Aug. 16, 2006

(65) Prior Publication Data

US 2008/0202877 A1 Aug. 28, 2008

Related U.S. Application Data

(63) Continuation of application No. 10/793,051, filed on Mar. 5, 2004, now Pat. No. 7,117,983, which is a continuation-in-part of application No. 10/700,251, filed on Nov. 4, 2003, now Pat. No. 6,942,203.

(51) Int. Cl.
*F16F 7/10* (2006.01)

(52) U.S. Cl. ..... 188/380; 415/135; 415/173.3; 73/865.9

(58) Field of Classification Search ..... 188/380; 267/136, 160; 415/135, 138, 139, 197, 173.1, 415/173.3, 175, 177, 178, 200; 73/865.9
See application file for complete search history.

(56) References Cited

U.S. PATENT DOCUMENTS

| | | | |
|---|---|---|---|
| 4,087,199 | A | 5/1978 | Hemsworth et al. |
| 4,245,954 | A | 1/1981 | Glenn |
| 4,621,976 | A | 11/1986 | Marshall et al. |
| 4,759,687 | A | 7/1988 | Miraucourt et al. |
| 5,346,362 | A | 9/1994 | Bonner et al. |
| 5,618,161 | A | 4/1997 | Papageorgiou et al. |
| 5,639,211 | A | 6/1997 | Bintz |
| 5,952,100 | A | 9/1999 | Corman et al. |
| 6,024,898 | A | 2/2000 | Steibel et al. |
| 6,113,349 | A | 9/2000 | Bagepalli et al. |
| 6,126,389 | A | 10/2000 | Burdgick |

(Continued)

OTHER PUBLICATIONS

"Melt Infiltrated (MI) SiC/SiC Composites for Industrial Gas Turbines", Krishan L. Luthra, Nov. 29, 2001, GE Corporate Research and Development, pp. 1-12.

(Continued)

*Primary Examiner*—Pam Rodriguez
(74) *Attorney, Agent, or Firm*—Nixon & Vanderhye P.C.

(57) ABSTRACT

A shroud support method and apparatus for a ceramic component of a gas turbine having: an outer shroud block having a coupling to a casing of the gas turbine; a spring mass damper attached to the outer shroud block and including a spring biased piston extending through said outer shroud block, wherein the spring mass damper applies a load to the ceramic component; and the ceramic component has a forward flange and an aft flange each attachable to the outer shroud block.

14 Claims, 4 Drawing Sheets

U.S. PATENT DOCUMENTS

| | | | |
|---|---|---|---|
| 6,138,997 | A | 10/2000 | Drager |
| 6,200,091 | B1 | 3/2001 | Bromann et al. |
| 6,258,737 | B1 | 7/2001 | Steibel et al. |
| 6,315,519 | B1 | 11/2001 | Bagepalli et al. |
| 6,365,233 | B1 | 4/2002 | Corman et al. |
| 6,403,158 | B1 | 6/2002 | Corman |
| 6,435,824 | B1 | 8/2002 | Schell et al. |
| 6,503,441 | B2 | 1/2003 | Corman et al. |
| 6,726,448 | B2 | 4/2004 | McGrath et al. |
| 6,814,538 | B2 | 11/2004 | Thompson |
| 6,932,566 | B2 | 8/2005 | Suzumura et al. |
| 6,942,203 | B2 | 9/2005 | Schroder et al. |

OTHER PUBLICATIONS

"Melt Infiltrated (MI) SiC/SiC Composites for Gas Turbine Applications", Krishan L. Luthra, Mar. 14, 2002, GE Corporate Research and Development, pp. 1-23.

Melt Infiltrated CMC Gas Turbine Shroud Development and Testing, DOE Continuous Fiber Ceramic Composite Program, DOE Advanced Materials for Advanced Gas Turbines Program, G. Corman et al., Jan. 27-30, 2003, pp. 1-20.

"Rig and Gas Turbine Engine Testing of MI-CMC Combustor and Shroud Components", G.S. Corman et al., Jun. 4-7, 2001, pp. 1-29.

SUPPORT APPARATUS AND METHOD FOR CERAMIC MATRIX COMPOSITE TURBINE BUCKET SHROUD

RELATED APPLICATION

This application is a continuation of U.S. patent application Ser. No. 10/793,051, filed Mar. 5, 2004, which is a continuation-in-part of application Ser. No. 10/700,251 (now U.S. Pat. No. 6,942,203), filed Nov. 4, 2003, and incorporates by reference the entirety of these applications.

BACKGROUND OF THE INVENTION

This invention relates to ceramic matrix components for gas turbines and, specifically, to testing of ceramic matrix turbine bucket shrouds.

The present invention relates to a support and damping system for ceramic shrouds surrounding rotating components in a hot gas path of a turbine and particularly relates to a spring mass damping system for interfacing with a ceramic shroud and tuning the shroud to minimize vibratory response from pressure pulses in the hot gas path as each turbine blade passes the individual shroud.

Ceramic matrix composites offer advantages as a material of choice for shrouds in a turbine for interfacing with the hot gas path. The ceramic composites offer high material temperature capability. It will be appreciated that the shrouds are subject to vibration due to the pressure pulses of the hot gases as each blade or bucket passes the shroud. Moreover, because of this proximity to high-speed rotation of the buckets, the vibration may be at or near resonant frequencies and thus require damping to maintain life expectancy during long-term commercial operation of the turbine. Ceramic composites, however, are difficult to attach and have failure mechanisms such as wear, oxidation due to ionic transfer with metal, stress concentration and damage to the ceramic composite when configuring the composite for attachment to the metallic components. Accordingly, there is a need for responding to dynamics-related issues relating to the attachment of ceramic composite shrouds to metallic components of the turbine to minimize adverse modal response.

Ceramic matrix composites can withstand high material temperatures and are suitable for use in, the hot gas path of gas turbines. Recently, melt-infiltrated (MI) silicon-carbon/silicon-carbon (SiC/SiC) ceramic matrix composites have been formed into high temperature, static components for gas turbines. Because of their heat capability, ceramic matrix composite turbine components, e.g., MI-SiC/SiC components, generally do not require or reduce cooling flows, as compared to metallic components.

BRIEF DESCRIPTION OF THE INVENTION

The invention may be embodied as a shroud support apparatus for a ceramic component of a gas turbine having: an outer shroud block having a coupling to a casing of the gas turbine; a spring mass damper attached to the outer shroud block and including a spring biased piston extending through said outer shroud block, wherein the spring mass damper applies a load to the ceramic component; and the ceramic component has a forward flange and an aft flange each attachable to the outer shroud block.

The invention may also be embodied as a shroud support for a melt-infiltrated ceramic matrix composite inner shroud for a row of turbine buckets of a gas turbine, said rig comprising: a metallic outer shroud block having a coupling to a casing of the gas turbine; a spring mass damper attached to said outer shroud block and further comprising a spring biased piston extending through said outer shroud block, wherein said piston is pivotably coupled to a pad; said ceramic matrix inner should having a forward flange and an aft flange each attachable to said outer shroud block, and wherein said pad applies a load to said ceramic component and pre-loads the forward and aft flanges.

The invention may be further embodied as a method for testing a ceramic stationary component of a gas turbine comprising: securing an outer shroud block to a casing of the gas turbine; attaching a forward flange and an aft flange of the component to the outer shroud; loading the component between the forward flange and the aft flange by applying a bias force to the component with a spring mass damper, and exposing the component to a hot gas stream in the gas turbine, wherein the bias force and the attachments of the forward flange and aft flange secure the component.

DETAILED DESCRIPTION OF THE INVENTION

Figure 1:
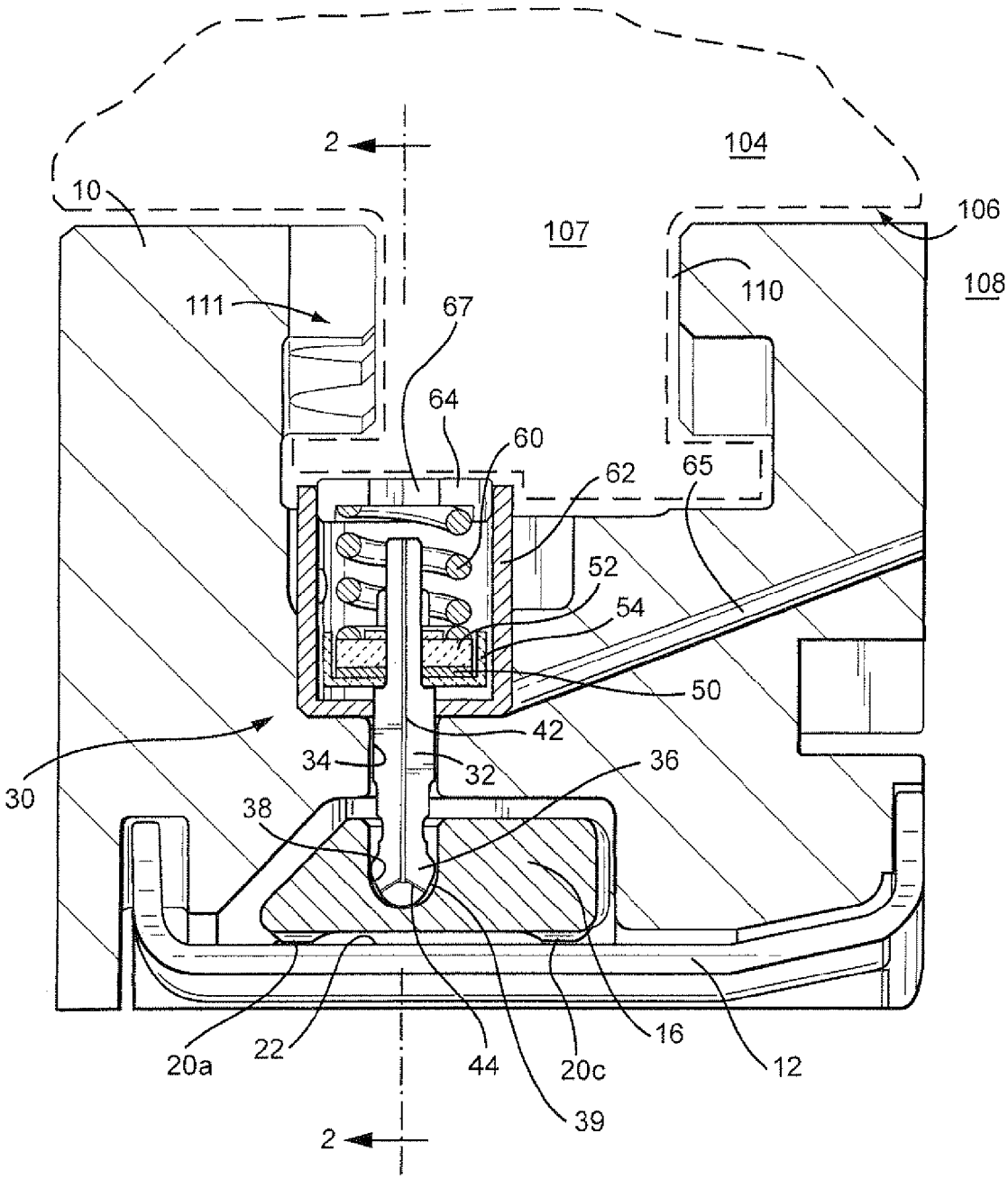
FIG. 1 is a cross-sectional view through an outer shroud block as viewed in a circumferential direction about an axis of the turbine and illustrating a preferred damper system according to the present invention.
Figure 2:
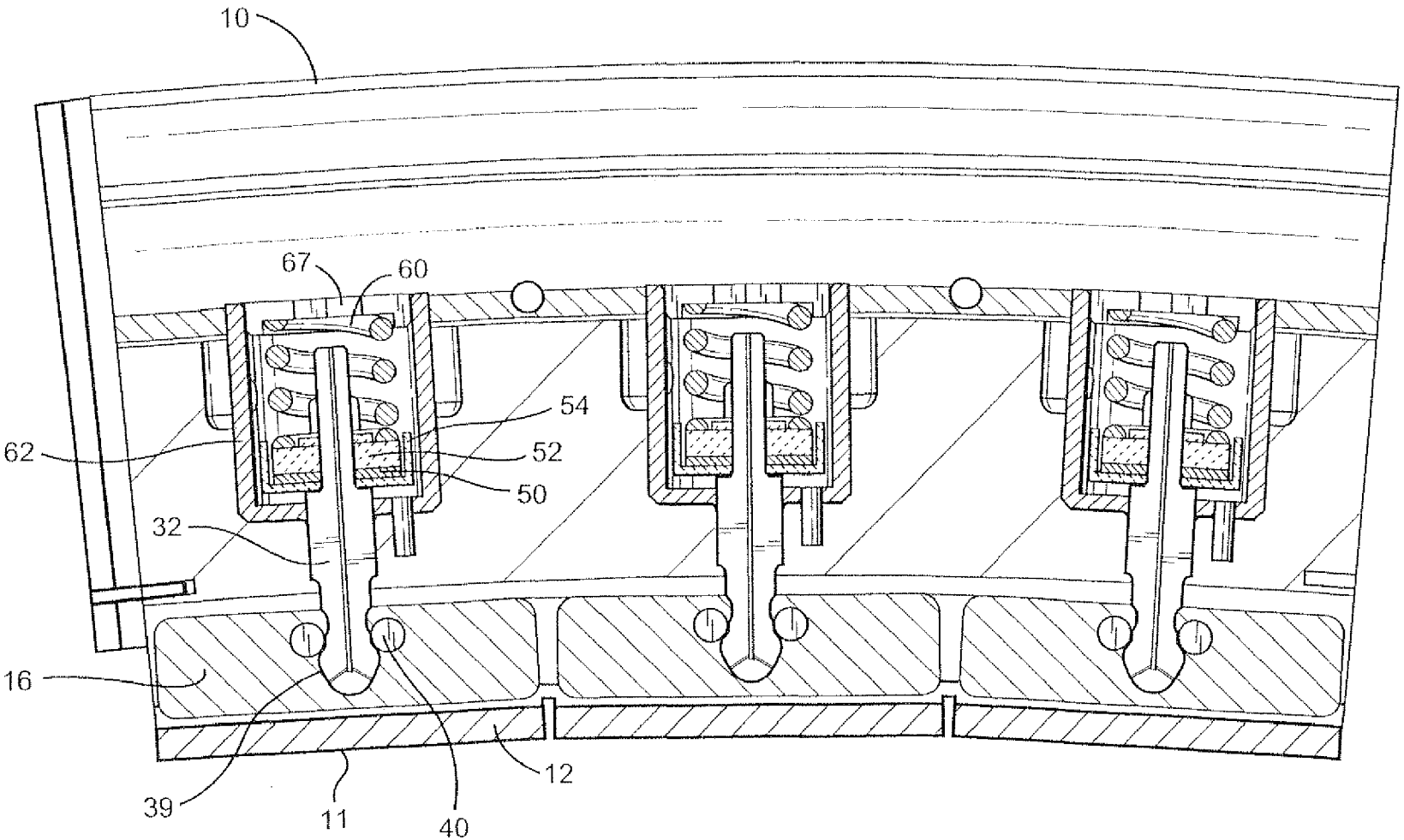
FIG. 2 is a cross-sectional view thereof as viewed in an axial forward direction relative to the hot gas path of the turbine.

Referring now to FIGS. 1 and 2, there is illustrated an outer shroud block or body 10 mounting a plurality of shrouds 12. FIG. 1 is a view in a circumferential direction and FIG. 2 is a view in an axial forward direction opposite to the direction of flow of the hot gas stream through the turbine. As seen from a review of FIG. 2, the shroud block 10 carries preferably three individual shrouds 12. It will be appreciated that a plurality of shroud blocks 10 are disposed in a circumferential array about the turbine axis and mount a plurality of shrouds 12 surrounding and forming a part of the hot gas path flowing through the turbine. The shrouds 12 are formed of a ceramic composite, are secured by bolts, not shown, to the shroud blocks 10, and have a first inner surface 11 (FIG. 2) in contact with the hot gases of the hot gas path.

The outer shroud block fits into the casing 104 of the gas turbine. The rig is mounted in the casing 104 on for example a casing 104 that extends inwardly from an inner wall 106 of the casing. The T-hook 107 may be arranged as an annular row of teeth that engages opposite sides of a groove 110 extending the length of the outer shroud block 10. The blocks 10 fit within a plenum cavity 108 within the casing and near the rotating portion of the gas turbine.

The outer shroud blocks 10 may be formed of a metal alloy that is sufficiently temperature tolerant to withstand moderate high temperature levels. A small portion of the metal outer shroud block, e.g., near the inner shroud 12, may be exposed to hot gases from the turbine flow path. The outer shroud block 10 connects to the gas turbine engine casing 104 by latching onto the T-hooks of the casing. The outer shroud block 10 may be a unitary block that slides over the T-hook or may be a pair of left and right block halves that are clamped over the T-hook. A slot 111 in an outer surface of the outer shroud block is configured to slide or clamp over the T-hook 107.

Figure 3:
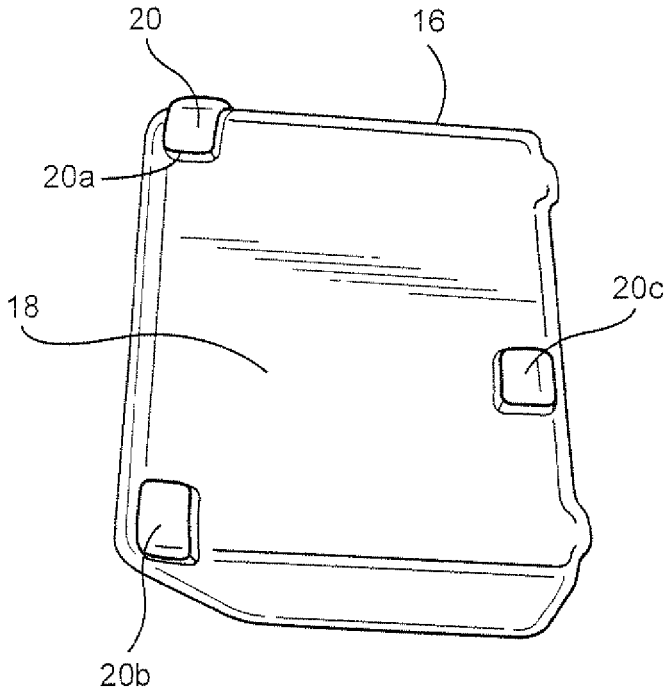
FIG. 3 is a perspective view illustrating the interior surface of a damper block with projections for engaging the backside of the shroud.

The damper system includes a damper block/shroud interface, a damper load transfer mechanism and a damping mechanism. The damper block/shroud interface includes a damper block 16 formed of a metallic material, e.g., PM2000, which is a superalloy material having high temperature use limits of up to 2200° F. As illustrated in FIGS. 1 and 3, the radially inwardly facing surface 18 (FIG. 3) of the damper block 16 includes at least three projections 20 which engage a backside surface 22 (FIG. 1) of the shroud 12. Projections 20 are sized to distribute sufficient load to the shroud 12, while minimizing susceptibility to wear and binding between the shroud 12 and damper block 16. The location of the projections 20 are dependent upon the desired system dynamic response which is determined by system natural frequency vibratory response testing and modal analysis. Consequently, the locations of the projections 20 are predetermined.

Two of the projections 20*a* and 20*b* are located along the forward edge of the damper block 16 and adjacent the opposite sides thereof. Consequently, the projections 20*a* and 20*b* are symmetrically located along the forward edge of the damper block 16 relative to the sides. The remaining projection 20*c* is located adjacent the rear edge of the damper block 16 and toward one side thereof. Thus, the rear projection 20*c* is located along the rear edge of block 16 and asymmetrically relative to the sides of the damper block 16. It will be appreciated also that with this configuration, the projections 20 provide a substantial insulating space, i.e., a convective insulating layer, between the damper block 16 and the backside of the shroud 12, which reduces the heat load on the damper block. The projections 20 also compensate for the surface roughness variation commonly associated with ceramic composite shroud surfaces.

The damper load transfer mechanism, generally designated 30, includes a piston assembly having a piston 32 which passes through an aperture 34 formed in the shroud block 10. The radially inner or distal end of the piston 32 terminates in a ball 36 received within a complementary socket 38 formed in the damper block 16 thereby forming a ball-and-socket coupling 39. As best illustrated in FIG. 2, the sides of the piston spaced back from the ball 36 are of lesser diameter than the ball and pins 40 are secured, for example, by welding, to the damper block 16 along opposite sides of the piston to retain the coupling between the damper block 16 and the piston 32. The coupling enables relative movement between the piston 32 and block 16. Excessive travel of the piston is sensed by closure of an electrical circuit (represented by contacts 102, 104) having a first contact 102 on the piston and a second contact 104 fixed with respect to the outer shroud block.

Figure 4:
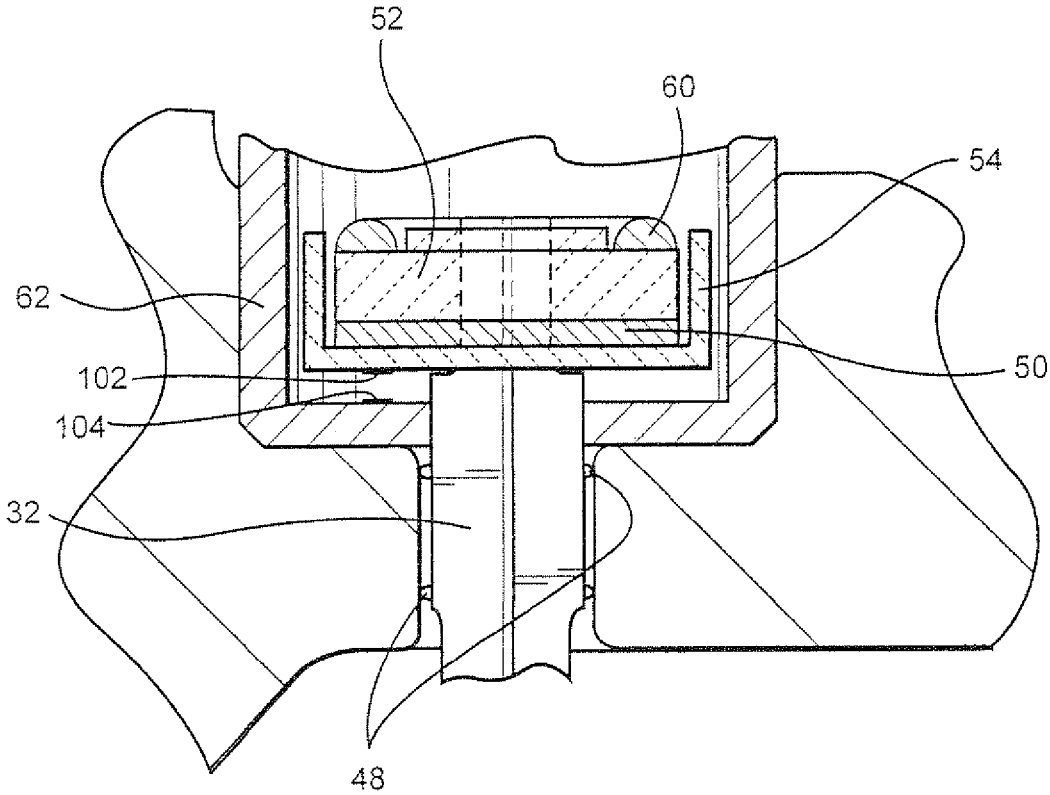
FIG. 4 is an enlarged cross-sectional view illustrating portions of the damper load transfer mechanism and damping mechanism.

A central cooling passage 42 is formed axially along the piston, terminating in a pair of film-cooling holes 44 for providing a cooling medium, e.g., compressor discharge air, into the ball-and-socket coupling. The cooling medium, e.g., compressor discharge air, is supplied from a source radially outwardly of the damper block 10 through the damping mechanism described below. As best illustrated in FIG. 4, the sides of the piston are provided with at least a pair of radially outwardly projecting, axially spaced lands 48. The lands 48 reduce the potential for the shaft to bind with the aperture of the damper block 10 due to oxidation and/or wear during long-term continuous operation.

The damper load transfer mechanism also includes superposed metallic and thermally insulated washers 50 and 52, respectively. The washers are disposed in a cup 54 carried by the piston 32. The metallic washer 50 provides a support for the thermally insulating washer 52, which preferably is formed of a monolithic ceramic silicone nitride. The thermally insulative washer 52 blocks the conductive heat path of the piston via contact with the damper block 12.

The damping mechanism includes a spring 60. The spring is pre-conditioned at temperature and load prior to assembly as a means to ensure consistency in structural compliance. The spring 60 is mounted within a cup-shaped block 62 formed along the backside of the shroud block 10. The spring is preloaded to engage at one end the insulative washer 52 to bias the piston 32 radially inwardly. The opposite end of spring 60 engages a cap 64 secured, for example, by threads to the block 62. The cap 64 has a central opening or passage 67 enabling cooling flow from compressor discharge air to flow within the block to maintain the temperature of the spring below a predetermined temperature. Thus, the spring is made from low-temperature metal alloys to maintain a positive preload on the piston and therefore is kept below a predetermined specific temperature limit. The cooling medium is also supplied to the cooling passage 42 and the film-cooling holes 44 to cool the ball-and-socket coupling. A passageway 65 is provided to exhaust the spent cooling medium. It will be appreciated that the metallic washer 50 retained by the cup 54 ensures spring retention and preload in the event of a fracture of the insulative washer 52.

It will be appreciated that in operation, the spring 60 of the damping mechanism maintains a radial inwardly directed force on the piston 32 and hence on the damper block 16. The damper block 16, in turn, bears against the backside surface 22 of the shroud 12 to dampen vibration and particularly to avoid vibratory response at or near resonant frequencies.

Figure 5:
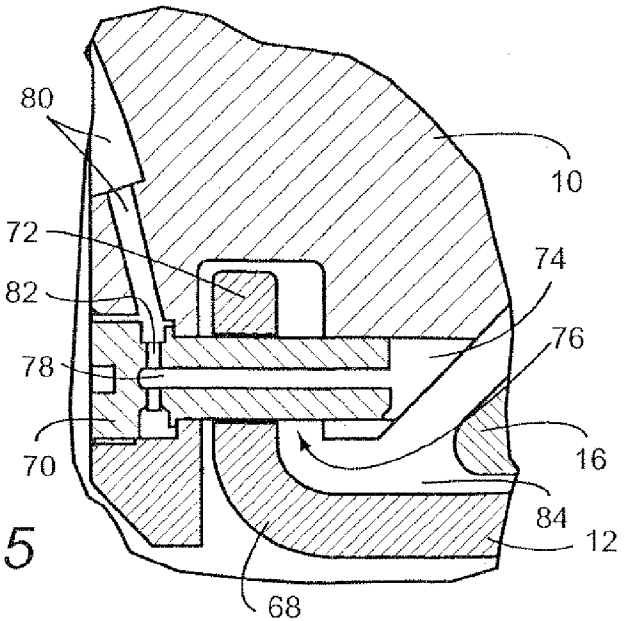
FIG. 5 is a close-up, cross-sectional view of a forward attachment for the shroud.

FIG. 5 is an enlarged view of a forward flange section 68 and the flange connector pin 70. The flange connector pin(s) 70 is inserted through an aperture(s) 72 of the forward flange 68 of the shroud 12. The pin 70 holds the shroud in place in the support block 10 and against the damper block 16. The pin 70 fits into a pin aperture 74 in the block, which includes a recess for the pin head. The pin aperture 74 extends across a gap 76 in the outer shroud block 10 to receive the forward flange 68.

The forward flange connector pin 70 includes a cooling passage 78 for cooling air. Cooling air flows through a cooling conduit 80 in the shroud block 10 to the pin. The pin 70 includes an axial cooling passage 78 that provides cooling air to the pin. Radial cooling passages 82 in the pin head allow cooling air from the conduit 80 to flow through the pin. Cooling gas passing through the pin and recess 62 is exhausted into the cavity 84 formed between the shroud block 10 and damper block 16.

Figure 6:
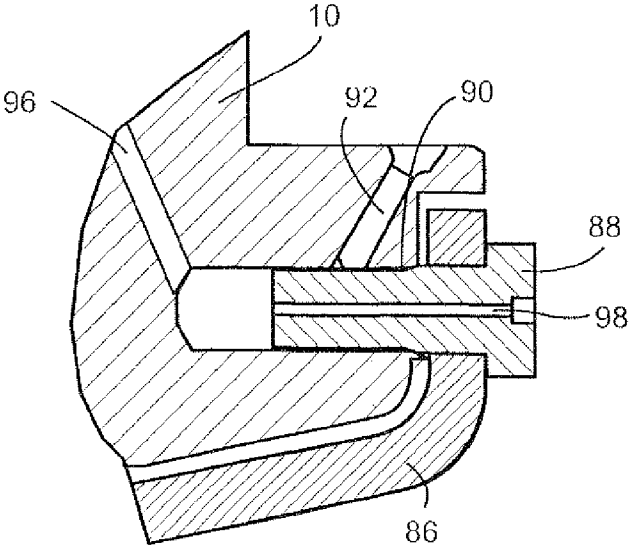
FIG. 6 is a close-up, cross-sectional view of an aft attachment for the shroud.

FIG. 6 is an enlarged view of a cross-section of the aft flange 86 and attachment bolt 88. The bolt screws into a threaded hole 90 in a side surface of the outer shroud block 10. A retention pin 92 locks the bolt in the outer shroud block. The aft attachment bolt securely fixes the aft flange 86 of the shroud 12 to the outer surface block.

The metal aft attachment bolt 88 is cooled by cooling air passing through the bolt and out passage 96 in the block 10. An axial passage 98 in the bolt allows cooling air to enter and cool the bolt.

Figure 7:
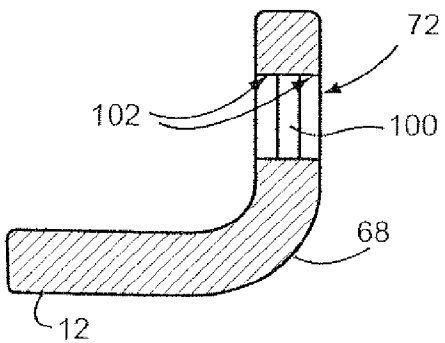
FIG. 7 is a close-up, cross-sectional view of a pin hole in forward flange of the shroud.

FIG. 7 is an enlarged view of the pin hole 72 in the forward shroud flange 68. The pin hole includes a cylindrical center section 100 and conical sections 102 on opposite sides of the center section. The conical sections may have a tapered slope of about 10 degrees with respect to the cylindrical surface of the center section. The outer surface of the shroud, including the flange and conical sections may be coated with an environmental barrier coating (EBC) conventionally used for silicon-carbide fiber-reinforced silicon carbide ceramic matrix composites (SiC/SiC CMCs)—which may be used to form the shroud. The cylindrical surface of the pin hole may be masked during EBC deposition.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for testing a ceramic stationary component of a gas turbine comprising:

a. securing an outer shroud block to a casing of the gas turbine;

b. attaching a forward flange and an aft flange of the component to the outer shroud;

c. loading the component between the forward flange and the aft flange by applying a bias force to the component with a spring mass damper which comprises a spring and a distinct damper having a different structural shape than the spring, wherein the bias force is applied to the component between the forward flange and the aft flange;

d. damping relative movement between the component and the outer shroud by the distinct damper, and e. exposing the component to a hot gas stream in the gas turbine.

2. A method as in claim 1 wherein the loading of the component is by applying the bias force to a surface of the component opposite to a surface of the component exposed to the hot gas stream.

3. A method as in claim 1 wherein the bias force is applied along a direction substantially normal to the hot gas stream.

4. A method as in claim 1 wherein the component is a melt-infiltrated ceramic matrix composite inner shroud for a row of turbine buckets of a gas turbine.

5. A method as in claim 1 further comprising directing cooling air through the outer shroud and mass spring damper.

6. A method as in claim 1 wherein the distinct damper is coaxial with the spring, wherein the spring is a coil spring.

7. A method as in claim 1 wherein the spring and the distinct damper apply a spring force and a damping force, respectively, wherein the spring force is aligned with the damping force along a direction of the relative movement.

8. A method for testing a ceramic stationary component of a gas turbine comprising:

a. securing an outer shroud block to a casing of the gas turbine;

b. attaching a forward flange and an aft flange of the component to the outer shroud;

c. loading the component between the forward flange and the aft flange by applying a bias force to the component with a spring mass damper which comprises a coil spring and a distinct damper, wherein the damper has a different structural shape than the spring, d. damping relative movement between the component and the outer shroud by the distinct damper, and e. exposing the component to a hot gas stream in the gas turbine.

9. A method as in claim 8 wherein the loading of the component is by applying the bias force to a surface of the component opposite to a surface of the component exposed to the hot gas stream.

10. A method as in claim 8 wherein the bias force and a damping force are coaxial.

11. A method as in claim 8 wherein the component is a melt-infiltrated ceramic matrix composite inner shroud for a row of turbine buckets of a gas turbine.

12. A method as in claim 8 further comprising directing cooling air through the outer shroud and mass spring damper.

13. A method as in claim 8 wherein the spring and the distinct damper apply a spring force and a damping force, respectively, wherein the spring force is aligned with the damping force along a direction of movement of the component.

14. A method for testing a ceramic stationary component of a gas turbine comprising:

a. securing an outer shroud block to a casing of the gas turbine;

b. attaching a forward flange and an aft flange of the component to the outer shroud;

c. loading the component between the forward flange and the aft flange by applying a bias force to the component with a spring mass damper which comprises a coil spring and a distinct damper, d. damping relative movement between the component and the outer shroud by the spring mass damper, wherein the distinct damper includes a shaft extending through the coil spring, and e. exposing the component to a hot gas stream in the gas turbine.

* * * * *